US005341147A

United States Patent [19]

Scott

[11] Patent Number: 5,341,147

[45] Date of Patent: Aug. 23, 1994

[54] METHOD FOR MEASURING AND CORRECTING ANTENNA RF BEAM ALIGNMENT

[75] Inventor: William G. Scott, Saratoga, Calif.

[73] Assignee: Space Systems/Loral, Inc., Palo Alto, Calif.

[21] Appl. No.: 949,714

[22] Filed: Sep. 23, 1992

[51] Int. Cl.[5] ..... H01Q 3/00

[52] U.S. Cl. ..... 342/360; 342/359; 342/174

[58] Field of Search ..... 342/359, 360, 174

[56] References Cited

U.S. PATENT DOCUMENTS

| | | | |
|---|---|---|---|
| 3,803,626 | 4/1974 | Garrett | 343/894 |
| 3,829,659 | 8/1974 | Margolis | 235/61.5 S |
| 4,119,964 | 10/1978 | Johannsen et al. | 343/17.7 |
| 4,489,322 | 12/1984 | Zulch et al. | 343/17.7 |
| 5,162,811 | 11/1992 | Lammers et al. | 343/915 |

OTHER PUBLICATIONS

"On The Equivalent Parabola Technique To Predict The Performance Characteristics Of A Cassegrainian System With Offset Feed", IEEE Trans. Antennas and Propagation, vol. 1 AP-21, No. 3, pp. 335-339, May 1973, By W. C. Wong.

*Primary Examiner*—Theodore M. Blum
*Attorney, Agent, or Firm*—Edward J. Radlo; Anthony W. Karambelas

[57] ABSTRACT

A method for predicting and compensating for angular beam misalignment of an antenna (101) due to antenna shape distortion resulting from gravitational effects. Measured (701, 702) antenna shape data in a target gravity loading environment and several test environments (600-603) are used to compute expected antenna beam misalignment angles in the test gravity loading environments (600-603). Actual antenna beam misalignment angles are measured (705) with the antenna (101) positioned in each of the test gravity loading environments (600-603). The expected antenna beam misalignment angles (704) are combined (707) with measured beam misalignment angles (705) to predict the beam misalignment of the antenna (101) in the target gravity loading environment. If the antenna (101) is an adjustable type, then the antenna (101) can be deliberately misaligned on the test range so that it will be properly aligned in the different gravity condition of the target environment. Further, thermal shape distortion data (706) can be incorporated to predict beam misalignment due to thermal distortion as well.

20 Claims, 6 Drawing Sheets

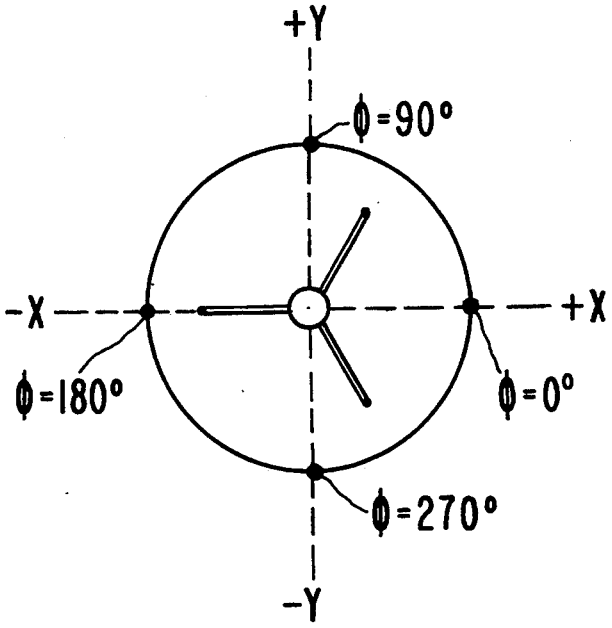
ANTENNA COORDINATES
FIG.6a
FIG.6b
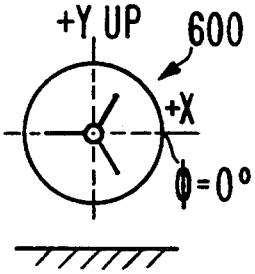
FIG.6c
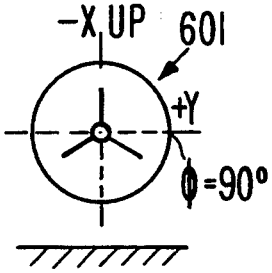
FIG.6d
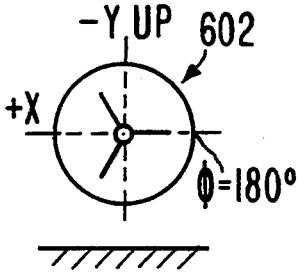
FIG.6e
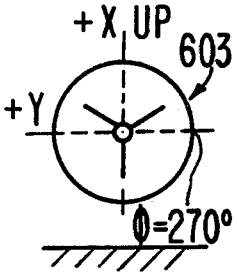
ANTENNA ORIENTATION (VIEWED FROM FRONT)

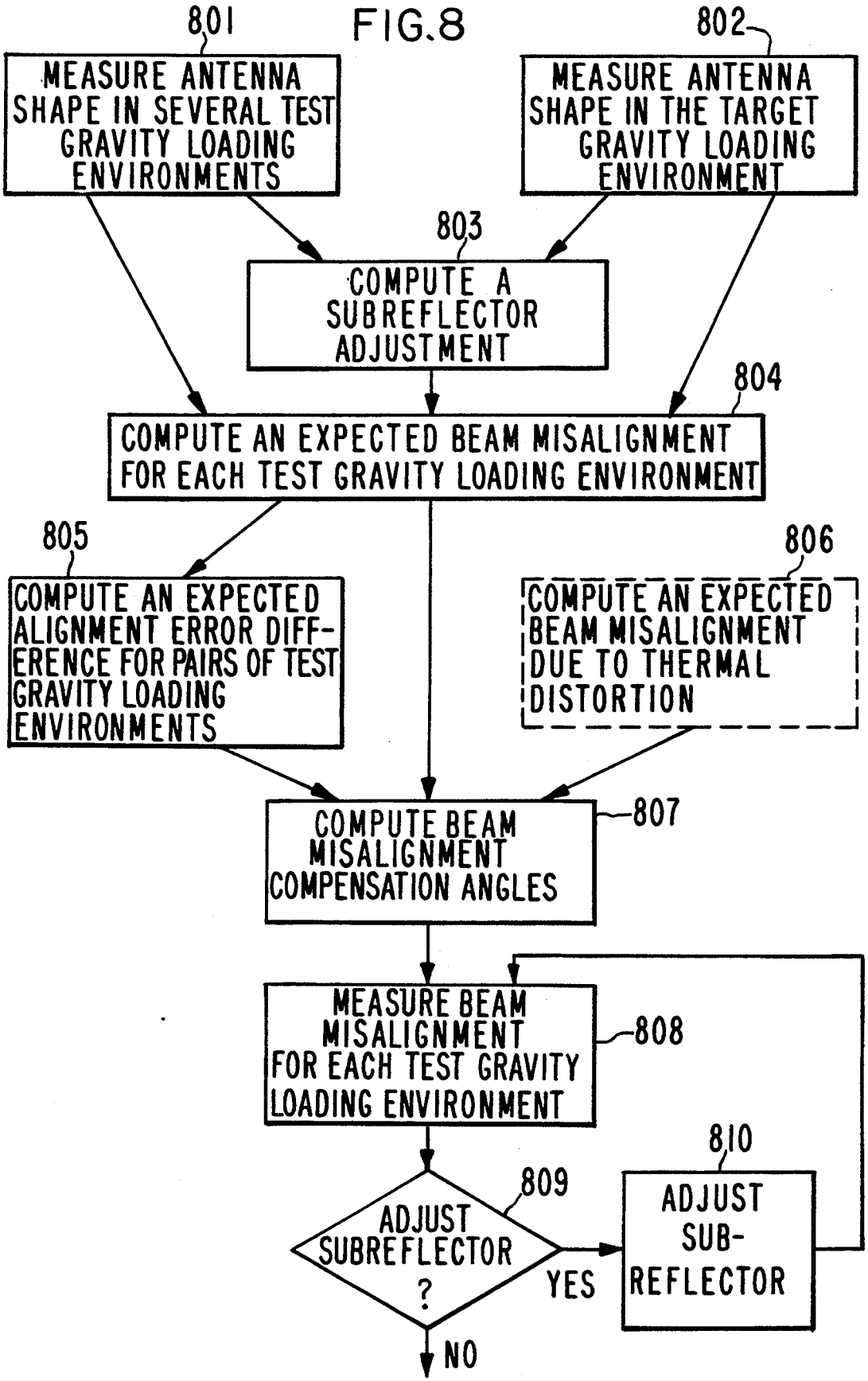
FIG.8
801
MEASURE ANTENNA SHAPE IN SEVERAL TEST GRAVITY LOADING ENVIRONMENTS
802
MEASURE ANTENNA SHAPE IN THE TARGET GRAVITY LOADING ENVIRONMENT
803
COMPUTE A SUBREFLECTOR ADJUSTMENT
804
COMPUTE AN EXPECTED BEAM MISALIGNMENT FOR EACH TEST GRAVITY LOADING ENVIRONMENT
805
COMPUTE AN EXPECTED ALIGNMENT ERROR DIFFERENCE FOR PAIRS OF TEST GRAVITY LOADING ENVIRONMENTS
806
COMPUTE AN EXPECTED BEAM MISALIGNMENT DUE TO THERMAL DISTORTION
807
COMPUTE BEAM MISALIGNMENT COMPENSATION ANGLES
808
MEASURE BEAM MISALIGNMENT FOR EACH TEST GRAVITY LOADING ENVIRONMENT
809
ADJUST SUBREFLECTOR ?
YES
NO
810
ADJUST SUB-REFLECTOR

METHOD FOR MEASURING AND CORRECTING ANTENNA RF BEAM ALIGNMENT

The invention described herein is a subject invention under U.S. government contract F04701-83-C-0025, and as such the U.S. government has certain rights therein.

DESCRIPTION

1. Field of the Invention

This invention relates first to a method for correcting measured antenna beam alignment data for a gravity sensitive antenna, and secondly for correcting said alignment. More specifically, the invention relates to predicting and compensating for the measured RF beam misalignment data of a narrow aperture antenna whose shape will distort in a target gravity loading environment that is different from the test gravity loading environment.

2. Description of Background Art

Most directive antenna radiation pattern test ranges are oriented horizontally over the earth. If the antenna has significant deflection due to gravity in the z-horizontal position, the resulting altered shape may alter its radiation pattern from that of other positions, and hence beam alignment relative to the designed geometric axis of the antenna. For example, when an earth mounted antenna aperture is pointed vertically (or "cup-up"), the alignment of the antenna radiation beam may be somewhat different from the alignment of the beam when the antenna is in the z-horizontal position. Large ground reflector antennas are always somewhat gravity sensitive, but this may have negligible effect if the antenna is designed with a relatively broad beam width. However, for narrow beam applications, the variation of beam alignment due to antenna shape distortion can be critical.

The alignment of an antenna beam where the antenna will be operating in a gravity loading environment that is different from the test environment has been handled in a number of different ways. The most simple minded has been the "do nothing" approach. Here, the antenna is aligned in a convenient gravity loading environment, and the misalignment that will occur as a result of shape distortion in the target position is ignored. The drawback with this approach is that the resulting misalignment can be greater than the allowed error tolerance. Another approach is to align the antenna in a test environment that has the same gravity loading conditions as the target loading environment. This approach is not always economically feasible, especially if the antenna will be operating in the cup-up (z-vertical) position with respect to the gravitational field. It is even less feasible if the antenna is designed to operate in a variety of different gravity loading environments. Another approach to the alignment problem has been to construct a temporary backup holding fixture to force the antenna to conform to its expected shape in the target gravity loading environment. This method is dependent upon the ability to accurately predict the expected antenna shape and to then reproduce that shape using the holding fixture. Building a fixture that will conform the antenna to the target shape can be costly, especially if the antenna has a narrow beam with small error tolerances.

U.S. Pat. No. 3,803,626 presents a method for measuring the effect of deformation of an antenna in a test environment using reflected light. However, it does not teach how to predict the misalignment or compensate for the misalignment in a gravity environment other than the test environment. Further, U.S. Pat. No. 3,803,626 teaches a method of measuring deformation whose accuracy is limited by the number of mirrors that are placed on the reflector surface. The present invention relies on measuring, to a high degree of accuracy, the antenna beam misalignment and shape in several test gravity loading environments. The present invention then uses the measured beam misalignment along with measured antenna shape data to compute an expected beam misalignment in a gravity loading environment that is different from the test environment.

Additional references are U.S. Pat. Nos. 3,829,659; 4,119,964; and 4,489,322.

DISCLOSURE OF INVENTION

The present invention describes a method for predicting a misalignment angle of an antenna beam (A,B) when the antenna (101) will be used in a target gravity loading environment (FIGS. 1 and 2) that is different from the test gravity loading environments (600–603) (of FIG. 3). The method comprises first measuring (701) the antenna (101) shape in several convenient test gravity loading environments (600–603) and measuring (702) the antenna shape in the target gravity loading environment (FIGS. 1, 2 and 3). Using the measured shapes, a position is computed (703) for an adjustable component of the antenna, for example an adjustable subreflector, and then an expected beam misalignment for each test environment is computed (704). The expected beam misalignments and the measured (705) beam misalignments for the test environments are used to compute (707) a predicted beam misalignment for the target gravity loading environment. This method applies to real antennas (101) such as reflectors which also have built in surface shape errors—random and/or systematic. Different gravity loading effects cause changes to the shape of any such real antenna (101).

To correct for the predicted beam misalignment in the target gravity loading environment, the present invention describes a method for calculating a deliberate beam misalignment angle in each of the test gravity loading environments. By deliberately misaligning the antenna beam in the test environments, the antenna will have correct beam alignment when placed in the target gravity loading environment. The desired beam misalignment angles are computed (807) using measured antenna shape data (201, 202) and using expected beam misalignments (computed from measured shape data) in the test gravity loading environments (804).

BRIEF DESCRIPTION OF THE DRAWINGS

FIG. 6*a* illustrates an antenna cup with four fixed points, 90 degrees apart, labelled phi=0 degrees, phi=90 degrees, phi=180 degrees and phi=270 degrees, respectively;

FIG. 6*b* illustrates an antenna in the +Y up position where the phi=0 degrees edge of the antenna is rolled to the farthest right position;

FIG. 6*c* illustrates an antenna in the −X up position where the phi=90 degrees edge of the antenna is rolled to the farthest right position;

FIG. 6*d* illustrates an antenna in the −Y up position where the phi=180 degrees edge of the antenna is rolled to the farthest right position;

FIG. 6*e* illustrates an antenna in the +X up position where the phi=270 degrees edge of the antenna is rolled to the farthest right position;

FIG. 8 is a flow chart of the antenna beam misalignment compensation method of the present invention;

DETAILED DESCRIPTION OF THE PREFERRED EMBODIMENTS

Figure 1:
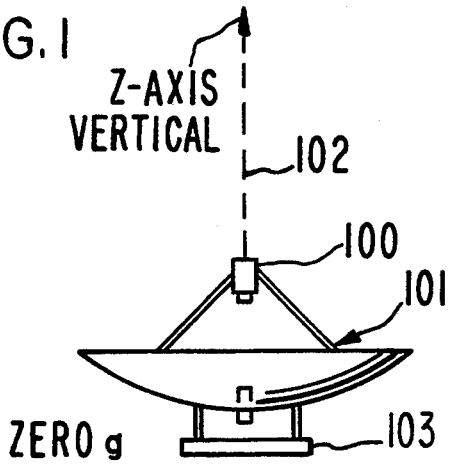
FIG. 1 illustrates a zero gravity or "zero-g" target gravity loading environment.
Figure 2:
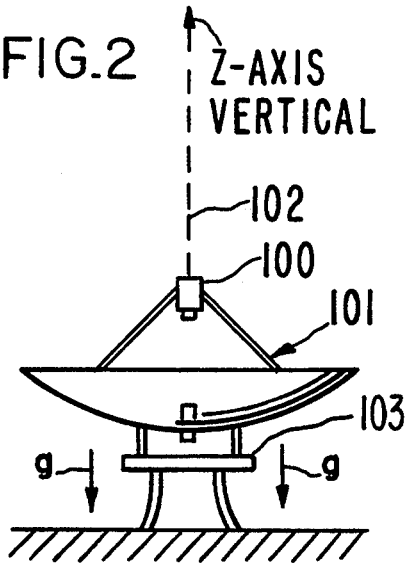
FIG. 2 illustrates the z-axis vertical or "cup-up" gravity loading environment.
Figure 3:
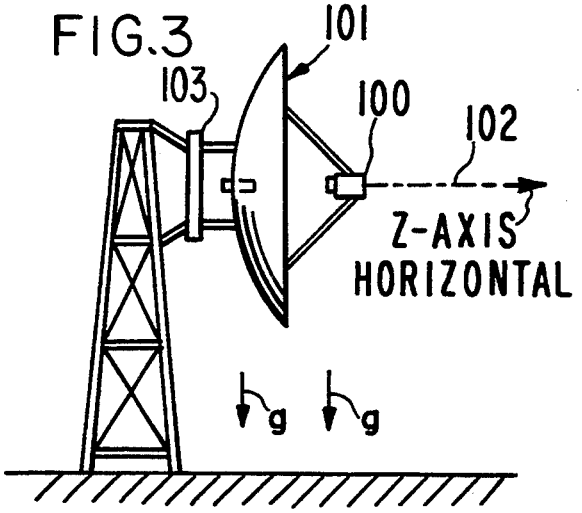
FIG. 3 illustrates the z-axis horizontal antenna orientation.

FIGS. 1 and 2 are examples of target gravity loading environments. FIG. 1 shows a zero gravity environment (such as when the antenna 101 is in outer space) and FIG. 2 shows a z-axis 102 vertical gravity loading environment. It is difficult and expensive to actually align the antenna 101 in these target environments. Typically antenna alignment is done in a more convenient test gravity loading condition such as z-axis 102 horizontal as is illustrated in FIG. 3. Antenna beam misalignment can result because the antenna shape in the test environment is different from its shape in the target environment due to the different gravity conditions.

Figure 4:
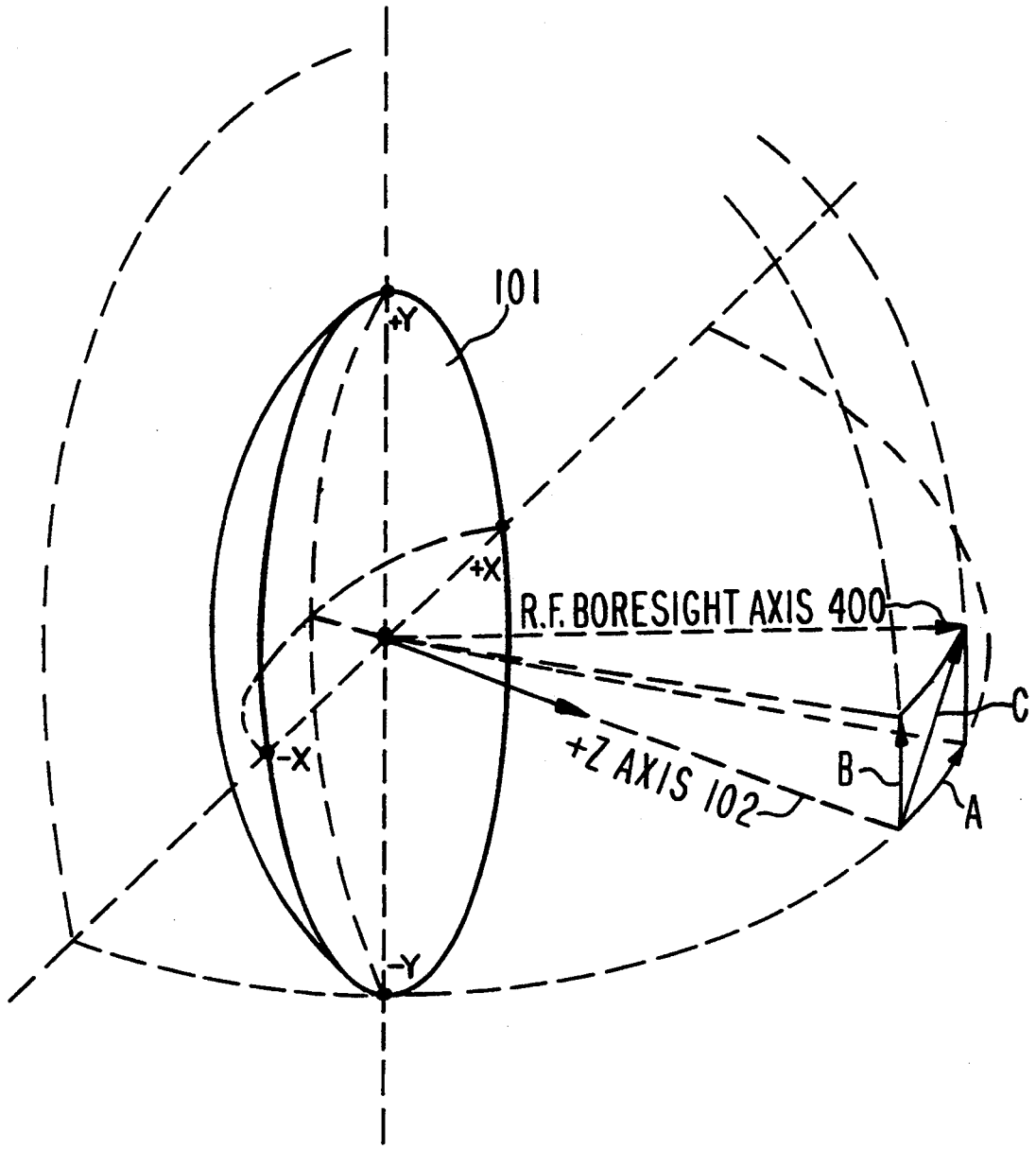
FIG. 4 illustrates the angular measurements of the antenna beam misalignment.
Figure 7:
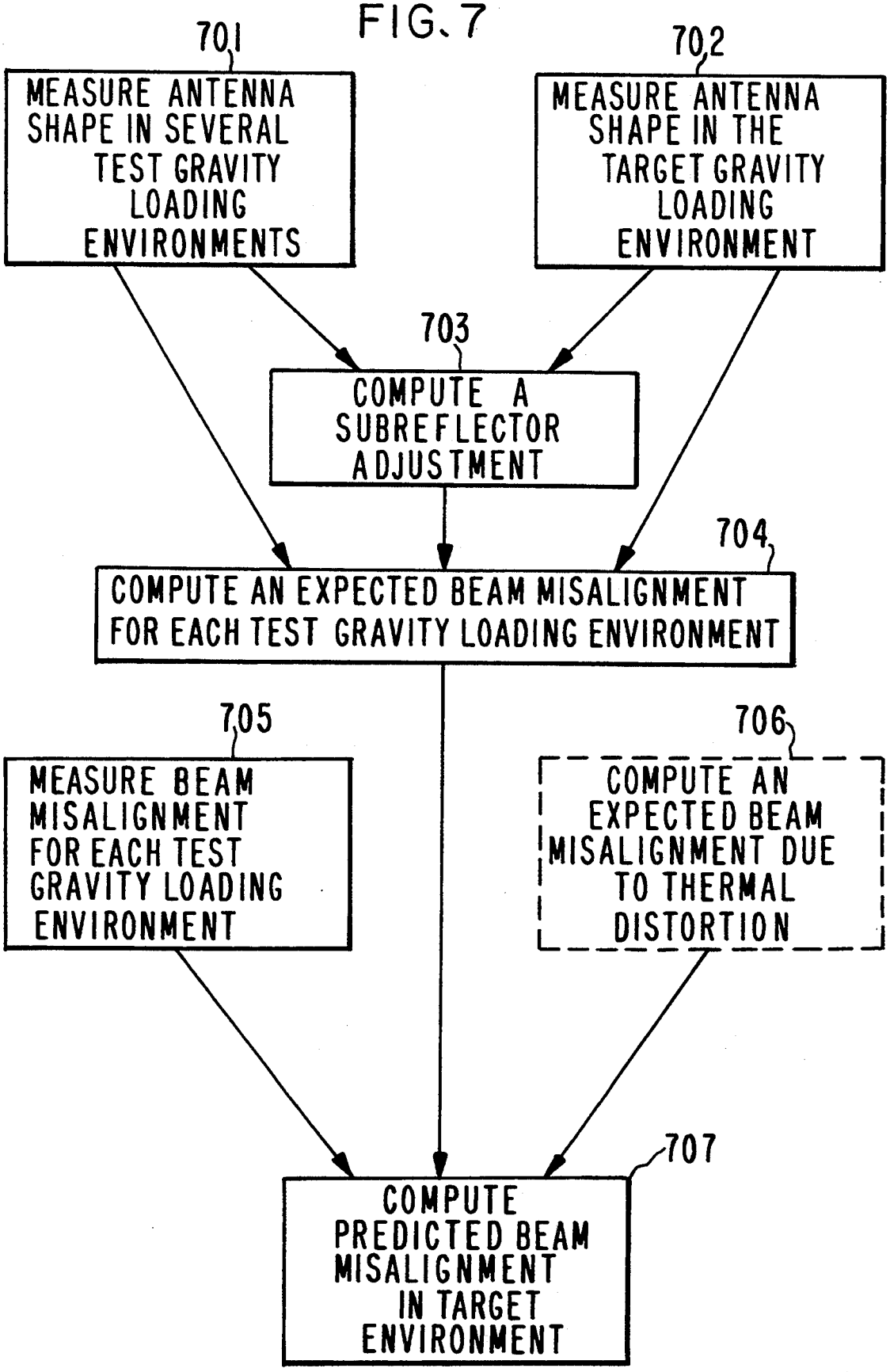
FIG. 7 is a flow chart of the antenna beam misalignment prediction method of the present invention.

The antenna beam misalignment, illustrated in FIG. 4, is measured as the angular difference C between the electrical bore sight axis 400 of the antenna 101 and the designed mechanical axis (z-axis) 102 of the antenna 101. The designed mechanical axis (z-axis) 102 of the antenna 101 is defined as being orthogonal to a rigid mounting plate 103 to which the antenna 101 is attached (see FIGS. 1–3). The mechanical axis (z-axis) 102 of the antenna 101 does not deflect significantly as the gravity loading environment changes. Because the antenna beam misalignment angle is measured in three dimensional space, it is defined by two angular measurements A,B as illustrated in FIG. 4. The z-axis labelled in FIG. 4 is the designed mechanical axis 102 of the antenna 101. The electrical bore sight axis 400 of the antenna 101 is defined by its angular deviation C from the antenna's mechanical axis (the z-axis) 102. C equals the square root of $(A^2+B^2)$. Angle A is the deviation from the z-axis in the ZX plane and the angle B is the deviation from the z-axis in the ZY plane, where x, y and z are three mutually orthogonal axes. It may be noted that manufacturing tolerances may result in a deformed shape antenna 101 in zero gravity. The antenna takes different shapes in various gravity orientations.

The distorted shape of the antenna 101 is measured 702 with the antenna 101 positioned in the target gravity loading environment. For a target loading environment of z-axis vertical with respect to a one-g gravitational field (FIG. 2), the antenna positioning and shape measurement is straight-forward using, for example, a coordinate measuring machine such as a Zeiss machine or a laser measurement device. For a zero-g, or weightless target environment (FIG. 1), the shape can be approximated by either the cup-up 1-g measurement or by combining the cup-up and cup-down measurements.

Figure 5:
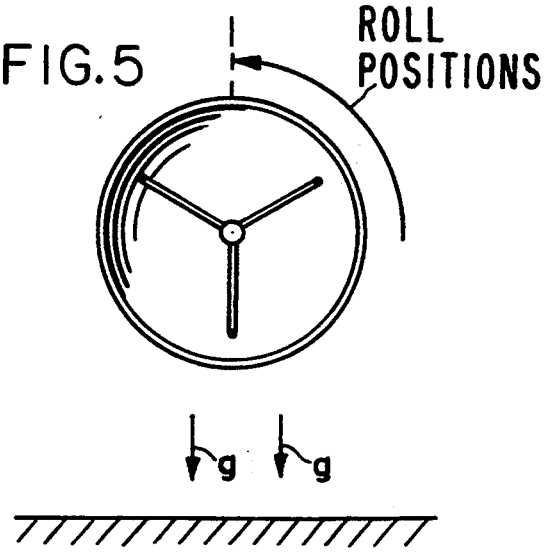
FIG. 5 illustrates rolling the antenna in the z-horizontal position.
Figure 9:
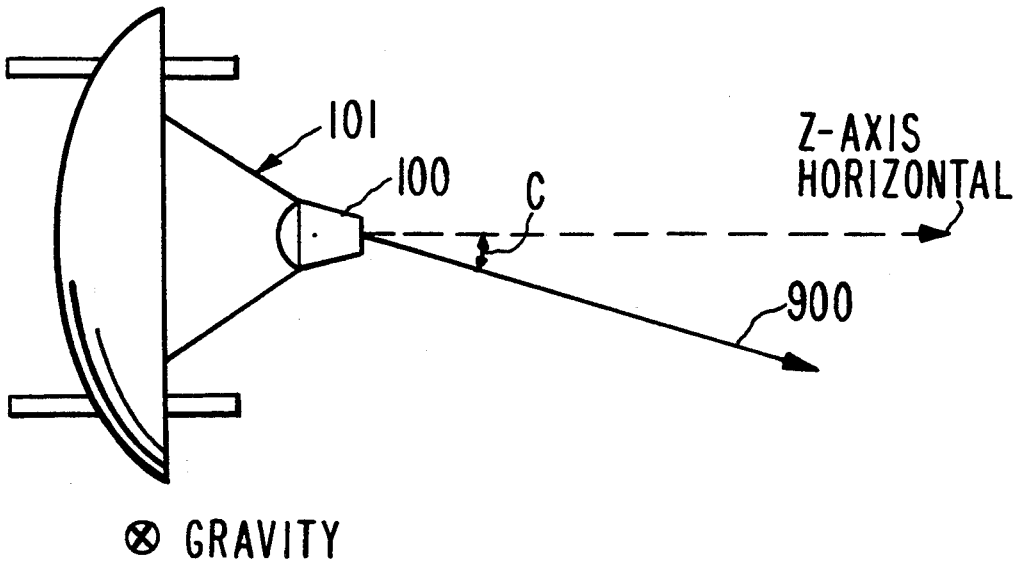
FIG. 9 shows a top view of an antenna (looking along the gravity vector) oriented with its z-axis horizontal with respect to the gravitational field and illustrates the horizontal component of the antenna beam misalignment angle.

The distorted antenna shape is also measured 701 in several convenient test gravity loading environments 600–603. As illustration, for a Cassegrain antenna 101, a set of convenient test gravity loading conditions are created by mounting the antenna with its z-axis horizontal with respect to the earth (FIG. 3) and then by rolling the antenna to four positions as illustrated in FIG. 5. As illustrated in FIG. 6*a*, four fixed points, 90 degrees apart, on an antenna cup can be labelled phi=0 degrees, phi=90 degrees, phi=180 degrees and phi=270 degrees, respectively. These fixed points can be referenced to identify the antenna 101 position when the antenna 101 is in one of several roll positions. By rolling the antenna 90 degrees at a time, four convenient test gravity loading conditions are created: +Y up 600, −Y up 602, −X up 601, and +X up 603 (see FIG. 9). For each antenna orientation with respect to the gravitational field, the distorted shape of the antenna is measured 701 using, for example, a Zeiss machine or a laser measurement device.

The measured antenna shapes in the target and test environments are used in the computation 703 of a mathematical adjustment for a moveable component of the antenna such as a subreflector. The adjustment that is computed is one that will minimize the angle of beam misalignment given the measured antenna shapes. Using the computed component adjustment 703 and the measured shape values 701, 702, an expected beam misalignment angle is computed 704 for the antenna in each test environment: +Y up 600, −Y up 602, −X up 601, and +X up 603. With the antenna positioned in each of the test environments, actual beam misalignment angles are measured 705. The actual beam misalignment angles and the expected beam misalignment angles are then used to predict the beam misalignment of the antenna in the target gravity loading environment. A preferred embodiment uses the following relation to predict the beam misalignment angles A, and B, for the target loading case of z-axis vertical with respect to a one-g gravitational field (FIG. 2):

$$\text{EQ1: } A=\tfrac{1}{2}*((X1-X2)-(X1'+X2'))$$

$$\text{EQ2: } B=\tfrac{1}{2}*((Y1-Y2)-(Y1'+Y2'))$$

where X1 and X2 are the horizontal (ZX plane) components C of the measured beam misalignment angles 900 when the antenna is positioned with +Y up 600 and −Y up 602 respectively; where X1′ and X2′ are the horizontal components (ZX plane) C of the computed beam misalignment angles 900 when the antenna is positioned with +Y up 600 and −Y up 602 respectively; where Y1 and Y2 are the horizontal components (ZY plane) C of the measured beam misalignment angles 900 when the antenna is positioned with +X up 601 and −X up 603 respectively; where Y1′ and Y2′ are the horizontal (ZY plane) components C of the computed beam misalignment angles 900 when the antenna is positioned with +X up 601 and −X up 603 respectively.

The computed angles X1′ and X2′ are computed from an RF computer model of the antenna 101 using the measured antenna shape data. First, using the target gravity loading environment measured antenna shape, for example, the measured shape when the antenna is cup-up as illustrated in FIG. 2, the computed beam misalignment angle is set to zero (three dimensionally) by mathematical adjustment of the subreflector 100 position. Next, using the measured +Y up 600 antenna shape data and the mathematically calculated subreflector position, the beam misalignment deflection in the ZX plane (X1') is computed. After this, using the measured −Y up antenna shape data and mathematically calculated subreflector position, the beam misalignment deflection in the ZX plane (X2') is computed. Angles Y1' and Y2' are computed in a similar way by using beam misalignment angles in the ZY plane for the +X up and −X up antenna positions.

Together, misalignment angle A and misalignment angle B describe the predicted antenna beam misalignment in three dimensional space (FIG. 4) when the antenna is placed in the target gravity loading environment.

The computed angles A, B, X1', X2', Y1', and Y2' are computed in antenna coordinates, a coordinate system that moves with the antenna as it is rolled. The angles X1, X2, Y1, and Y2 are measured in antenna range azimuth coordinates, the fixed coordinate system of the antenna range.

A preferred embodiment also includes the calculation 706 of the beam misalignment due to thermal distortion. The thermal calculation may occur at any time prior to the calculation of the predicted beam misalignment in the target environment 707. The calculation of this term is familiar to those practiced in the art.

Additionally, if the antenna is adjustable, for example a Cassegrain antenna 101 with an adjustable subreflector 100, the antenna can be deliberately misaligned to compensate for the predicted beam misalignment in the target gravity loading environment. The deliberate misalignment angles are derived from the computed expected beam misalignment for each test gravity loading environment 804. The steps required to calculate the expected beam misalignment angles 801, 802, 803 and 804 are identical to the previously described steps 701, 702, 703 and 704 respectively. The deliberate misalignment angles are calculated 807 by setting the two equations EQ1 and EQ2 to zero and solving for the X1−X2 difference and the Y1−Y2 difference. The expected alignment errors X1'+X2' and Y1'+Y2' which are used in EQ1 and EQ2 are calculated 805 prior to solving for the X1−X2 difference and the Y1−Y2 difference. The beam misalignment for +X up 601, −X up 603, +Y up 600 and −Y up 602 is measured 808 and the subreflector 100 is adjusted 810 if the misalignment is greater than the allowed tolerance. The process of measuring the beam alignment and adjusting the subreflector is repeated until the desired measured misalignment condition (X1−X2) and Y1−Y2) is reached 809. Optionally, a preferred embodiment may include the calculation 806 of the beam misalignment due to thermal distortion. The thermal distortion calculation may occur at any time prior to the calculation of the beam misalignment compensation angles 807. The calculation of this thermal distortion term is familiar to those practiced in the art.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A method for predicting a target misalignment angle of a beam of an antenna when said antenna is in a target gravity loading environment, said antenna having a gravity sensitive shape, said method comprising the steps of:

(a) measuring said antenna shape in several test gravity loading environments;

(b) measuring said antenna shape in said target gravity loading environment;

(c) computing an adjustment for an antenna component that changes beam direction so as to minimize an angle of beam misalignment for said measured antenna shapes from steps (a) and (b);

(d) for each of said several test gravity loading environments and said target gravity loading environment, computing an expected shape beam misalignment angle from said measured antenna shapes from steps (a) and (b) and using said computed adjustment that minimizes said angle of beam misalignment for said antenna component that changes beam direction;

(e) measuring a test beam misalignment angle in said several test gravity loading environments; and (f) computing said target beam misalignment angle using said measured test beam misalignment angles and using said computed shape beam misalignment angles.

2. The method as defined by claim 1 wherein said antenna is a paraboloidal antenna.

3. The method as defined by claim 1 wherein said antenna component that changes beam direction is a subreflector.

4. The method as defined by claim 1, further comprising, before performing step (f), the step of, computing an expected temperature beam misalignment angle of said antenna due to thermal distortion, wherein:

step (f) takes into account said expected temperature beam misalignment angle.

5. The method of claim 4 wherein said several test gravity loading environments comprise four Z-horizontal positions: +Y up, −Y up, +X up, and −X up with respect to the gravitational field.

6. The method of claim 5 wherein said target gravity loading environment is one in which the antenna is Z-up with respect to the gravitational field.

7. The method of claim 1 wherein said several test gravity loading environments comprise four Z-horizontal positions: +Y up, −Y up, +X up, and −X up with respect to the gravitational field.

8. The method of claim 7 wherein said target gravity loading environment is one in which the antenna is Z-up with respect to the gravitational field.

9. A method to align an antenna beam for operation in a target gravity loading environment, said antenna having a gravity sensitive shape, said method comprising the steps of:

(a) measuring said antenna shape in several test gravity loading environments;

(b) measuring said antenna shape in said target gravity loading environment;

(c) computing an adjustment for an antenna component that changes beam direction so as to minimize an angle of beam misalignment for said measured antenna shapes from steps (a) and (b);

(d) for each of said several test gravity loading environments and said target gravity loading environment, computing an expected antenna beam misalignment angle from said measured antenna shapes from steps (a) and (b) and using said computed antenna component adjustment that minimizes said angle of beam misalignment;

(e) computing a beam compensation alignment angle using said expected antenna beam misalignment angle;

(f) measuring a test beam alignment angle in said several test gravity loading environments;

(g) adjusting said antenna component that changes beam direction; and (h) repeating steps (f) and (g) until said measured test beam alignment angle is within a predetermined range of angular values to said computed beam compensation alignment angle.

10. The method as defined by claim 9 wherein said antenna is a paraboloidal antenna.

11. The method as defined by claim 9 wherein said antenna component that changes beam direction is a subreflector.

12. The method of claim 9 wherein said several test gravity loading environments comprise four Z-horizontal positions: +Y up, −Y up, +X up, and −X up with respect to the gravitational field.

13. The method of claim 12 wherein said target gravity loading environment is one in which said antenna is Z-up with respect to the gravitational field.

14. The method of claim 13 wherein step (e) comprises the substeps of:

(e.1) computing a difference between said +Y up and said −Y up computed misalignment angles;

(e.2) computing a difference between said +X up and said −X up computed misalignment angles;

(e.3) computing an X—X plane beam misalignment compensation angle using said computed difference from step (e.1), said computed misalignment angle for said +Y up antenna position, and said computed misalignment angle for said −Y up antenna position; and (e.4) computing a Y—Y plane beam misalignment compensation angle using said computed difference from step (e.2), said computed misalignment angle for said +x up antenna position, and said computed misalignment angle for said −X up antenna position.

15. A method to align an antenna for operation in a target gravity loading environment, said antenna having a gravity sensitive shape and a temperature sensitive shape, said method comprising the steps of:

(a) measuring said antenna shape in several test gravity loading environments;

(b) measuring said antenna shape in said target gravity loading environment;

(c) computing an adjustment for an antenna component that changes beam direction so as to minimize an angle of beam misalignment for said measured antenna shapes from steps (a) and (b);

(d) for each of said several test gravity loading environments, computing an expected temperature misalignment angle due to thermal distortion resulting from a predetermined expected temperature;

(e) for each of said several test gravity loading environments, computing an expected shape misalignment angle from said measured antenna shapes from steps (a) and (b) and using said computed adjustment that minimizes said angle of beam misalignment for said antenna component that changes beam direction;

(f) computing a beam compensation alignment angle using said predetermined expected temperature and shape misalignment angles from steps (d) and (e), respectively;

(g) measuring a beam alignment angle in said several test gravity loading environments;

(h) adjusting said antenna component that changes beam direction; and (i) repeating steps (g) and (h) until said measured beam alignment angle is within a predetermined range of angular values of said computed beam compensation alignment angle.

16. The method as defined by claim 15 wherein said antenna is a paraboloidal antenna.

17. The method as defined by claim 15 wherein said antenna component that changes beam direction is a subreflector.

18. The method of claim 15 wherein said target gravity loading environment is one in which the antenna is Z-up with respect to the gravitational field.

19. The method of claim 15 wherein said several test gravity loading environments comprise four Z-horizontal positions: +Y up, −Y up, +X up, and −X up with respect to the gravitational field.

20. The method of claim 19 wherein step (f) comprises the substeps of:

(f.1) computing a difference between said +Y up and said −Y up computed shape misalignment angles;

(f.2) computing a difference between said +X up and said −X up computed shape misalignment angles;

(f.3) computing an X—X plane beam misalignment compensation angle using said temperature misalignment angle, said computed difference from step (f.1), said computed shape misalignment angle for said +Y up antenna position, and said computed shape misalignment angle for said −Y up antenna position; and (f.4) computing a Y—Y plane beam misalignment compensation angle using said temperature misalignment angle, said computed difference from step (f.2), said computed shape misalignment angle for said +X up antenna position, and said computed shape misalignment angle for said −X up antenna position.

* * * * *